US005575302A

United States Patent [19]

Blöcker et al.

[11] Patent Number: 5,575,302

[45] Date of Patent: Nov. 19, 1996

[54] FILTER FOR REMOVING NITROGEN OXIDES FROM TOBACCO SMOKE

[75] Inventors: Erich Blöcker, Hofheim; Andreas Schleicher, Einhausen, both of Germany

[73] Assignee: Hoechst Aktiengesellschaft

[21] Appl. No.: 359,556

[22] Filed: Dec. 20, 1994

[30] Foreign Application Priority Data

Dec. 22, 1993 [DE] Germany ..... 43 43 920.9

[51] Int. Cl.[6] ..... A24D 3/06; A24D 3/10

[52] U.S. Cl. ..... 131/345; 131/332; 131/342

[58] Field of Search ..... 131/331, 332, 131/334, 341, 342, 345

[56] References Cited

U.S. PATENT DOCUMENTS

| | | |
|---|---|---|
| 3,434,479 | 3/1969 | Till et al. . |
| 4,661,299 | 4/1987 | Thorsrud . |
| 4,749,598 | 6/1988 | Miles . |
| 4,763,674 | 8/1988 | Lelah . |
| 4,767,799 | 8/1988 | Thorsrud . |
| 4,790,965 | 12/1988 | Thorsrud . |
| 4,810,590 | 3/1989 | Rich . |
| 4,968,726 | 11/1990 | Thorsrud . |
| 5,083,579 | 1/1992 | Vanin et al. . |

FOREIGN PATENT DOCUMENTS

| | | |
|---|---|---|
| 0351252 | 1/1990 | European Pat. Off. . |
| 3712836C2 | 10/1987 | Germany . |
| 2150806 | 12/1987 | United Kingdom . |
| 9505894 | 3/1995 | WIPO . |

OTHER PUBLICATIONS

Rompp Chemie Lexikon, 9, Aufl,., Bd. 6 (1992) 4435.
Rompp Chemie Lexikon, 9, Aufl., Bd. 5 4316.

*Primary Examiner*—Jennifer Bahr
*Attorney, Agent, or Firm*—Connolly & Hutz

[57] ABSTRACT

A filter for removing nitrogen oxides ($NO_x$) from tobacco smoke comprises A) a poly(arylene thioether), B) if appropriate a conventional filter material and C) if appropriate at least one surface-active solid. By means of use of this filter, in particular, nitrogen dioxide is virtually completely removed from the smoke.

10 Claims, No Drawings

FILTER FOR REMOVING NITROGEN OXIDES FROM TOBACCO SMOKE

DESCRIPTION

The present invention relates to a filter for removing nitrogen oxides from tobacco smoke.

Tobacco smoke is the aerosol formed in the burning of tobacco and, as is known, contains a very large number—estimated at several thousand—of chemical compounds. The gas phase of the tobacco smoke has a relatively simple composition and, in addition to the known air constituents, contains carbon monoxide, hydrogen, hydrogen cyanide, ammonia, nitrogen oxides and traces of hydrogen sulfide and organic compounds (Römpp Chemie Lexikon [Römpp Chemistry Lexicon], 9th edition, volume 6 (1992), p. 4435).

In addition to the characteristic flavor substances, the best known and most physiologically relevant constituents are the alkaloid nicotine and the gaseous toxins such as carbon monoxide, nitrogen oxides ($NO_x$) and prussic acid, as well as the tar constituents, acrolein and tobacco-specific nitrosamines.

Attempts have therefore been made for a long time to influence, by passage through a filter, the composition of tobacco smoke in such a way that particularly toxic constituents having immediate or long term effects are removed without impairing too much the flavor of the smoke and the physiological effect desired by the smoker. The principle focus of attention has been placed here on removing certain gaseous constituents and the tar constituents of the smoke, and less so on decreasing the nicotine content.

The filters used for this purpose contain adsorptive materials of a preferably fibrous or highly porous structure, e.g. cellulose fibers (crepe paper filters), cellulose acetate fibers, polypropylene fibers, aluminum oxide, silica gel, meerschaum or activated charcoal.

Activated charcoal filters, depending on the available inner surface area, selectively adsorb up to 85% of the gas/vapor phase constituents, but in contrast scarcely any of the particle phase. In contrast, fiber filters and powder filters (except for activated charcoal) preferentially retain the particle phase, i.e. the tar constituents and therefore have particularly conspicuous effects on the flavor of tobacco smoke.

Nitrogen oxides are contained in tobacco smoke at 0.02% of the gas phase. A relatively long duration of action of nitrogen oxides which irritate the respiratory pathways and mucus membranes can lead to occurrences of bronchitis and edema (Römpp Chemie Lexikon [Römpp Chemistry Lexicon], 9th edition, volume 5 (1992), p. 4316). It is therefore desirable, and attempts have already been made for a relatively long period, also to remove nitrogen oxides from tobacco smoke as effectively as possible by special filter compositions.

Partial adsorption of nitrogen monoxide and carbon monoxide has been achieved by transition metal complexes having oxime ligands on inert granules (GB-B 2 150 806). Furthermore, a tobacco smoke filter for nitrogen monoxide has been described which was obtained by impregnating cellulose fibers or cellulose acetate fibers with a complex of iron(II) ion and a low-molecular thiol (EP-A 351 252). Both methods exploit the potential of the NO molecule for easy formation of addition complexes with suitable transition metal compounds.

Partial removal of nitrogen dioxide from tobacco smoke has been achieved by impregnating a non-oxidizable, particulate adsorbent having a high surface area or high pore volume with a permanganate salt (U.S. Pat. No. 3,434,479).

In addition, a process is known for selective removal of toxic components such as HCN and NO from cigarette smoke. In this case, inorganic or organic substances which remove the toxic compounds during the smoking process are applied to conventional cigarette filter material (DE-C 37 12 836).

Nitrogen oxides, in particular nitrogen dioxide, can be virtually completely removed from gases and liquids by poly(arylene thioethers) (German Patent Application P 43 28 450.7 of Aug. 24 1993, title "Filtermaterial und Verfahren zur Entfernung von Stickoxiden aus Gasen und Flüssigkeiten [Filter material and process for removing nitrogen oxides from gases and liquids]").

The object of the invention is to provide a tobacco smoke filter which can remove nitrogen oxides ($NO_x$) virtually quantitatively and is simple to produce.

The invention relates to a filter for removing nitrogen oxides ($NO_x$) from tobacco smoke, in particular for removing nitrogen dioxide, which comprises A) a poly(arylene thioether) having repeating units of the formula $$-[(Ar^1)_n-X]_m-[(Ar^2)_i-Y]_j-[(Ar^3)_k-Z]_l-[(Ar^4)_o-W]_p- \quad (I)$$

in the form of fibers, films and/or powder, in which $Ar^1$, $Ar^2$, $Ar^3$, $Ar^4$, W, X, Y and Z, independently of each other, are identical or different, the indices n, m, i, j, k, l, o and p, independently of each other, are zero or integers 1, 2, 3 or 4, their sum being at least 2, $Ar^1$, $Ar^2$, $Ar^3$ and $Ar^4$ are arylene systems having 6 to 18 carbon atoms and W, X, Y and Z are divalent linking groups selected from the group consisting of —S—, —SO—, —$SO_2$—, —O—, —CO—, —$CO_2$— or alkylene groups or alkylidene groups having 1 to 6 carbon atoms, B) if appropriate a conventional filter material and C) if appropriate at least one surface-active solid.

The component B) can be composed of cellulose, cellulose acetate and/or polyolefins, e.g. polypropylene. Adsorptive materials for removing gaseous smoke constituents and/or for removing aerosol particles contained in smoke can be used as component C). Examples of these are aluminum oxide, silica gel, meerschaum and activated charcoal.

The poly(arylene thioether) preferably used is poly(phenylene sulfide) (PPS) having the repeating unit of the formula (II):

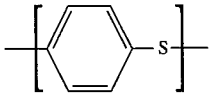

(II)

The PPS of formula (II) can also have a 1,2- and/or 1,3-linkage to the aromatic nucleus up to a content of 50 mol %. "PPS" is taken to mean both the linear and the crosslinked material.

Generally, poly(arylene thioethers) are suitable which have a mean molecular weight of 4000 to 200,000, preferably 10,000 to 150,000, in particular 25,000 to 100,000, determined by GPC.

Powders A) used in the filter according to the invention have commercial particle sizes, i.e. their mean particle size is generally up to 300 μm, preferably 20 to 100 μm. If, to produce the tobacco smoke filter, the polymers of the component A) are used in the form of fibers, these can be used, for example, as continuous filaments or staple fibers, preferably having staple lengths of 0.5 to 50 mm or as split fibers or split-film fibers, but also as "nonwoven" material, carded silver or woven cloth. However, the poly(arylene thioethers) A) can also be used as films or film shreds in a suitable form in the tobacco smoke filters. It is important that the tobacco smoke can be passed through without disturbance or observable pressure drop.

Nitrogen dioxide is generally removed quantitatively from the tobacco smoke by the polymer A). However, in contrast to the nitrogen dioxide, nitrogen monoxide is only removed to a small extent. However, by means of the addition of oxidizing compounds, i.e. at least one oxidizing inorganic or organic compound which has an electrode potential of greater than or equal to 0.96 V, such as vanadium pentoxide or dichlorodicyanoquinone, separation proceeds virtually quantitatively in this case too.

The filter according to the invention can be used, for example, in the production of filter cigarettes and can be incorporated into the known filter structures. The filter can also be used for pipes, cigarette holders and cigar holders, for example in the form of filter cartridges.

Generally, the content of poly(arylene thioethers) A) can be up to 50% by weight of the total weight of the filter in order to ensure reliable removal of the nitrogen oxides, but preferably at least 5% by weight.

If the poly(arylene thioether) A) is used in the form of fibers in tobacco smoke filters according to the invention, these fibers can either be localized in a separate spatial section of the filter or else be used in a mixture with the conventional fiber materials used for smoke filters.

We claim:

1. A combination comprising tobacco smoking means and a filter associated with the tobacco smoking means for filtering tobacco smoke generated by the tobacco smoking means, and wherein the filter includes a poly(arylene thioether).

2. The combination as claimed in claim 1, wherein the poly(arylene thioether) is poly(phenylene sulfide).

3. The combination as claimed in claim 1, wherein the poly(arylene thioether) has a mean molecular weight of 4000 to 200,000 and is 5 to 50% by weight of the filter.

4. The combination as claimed in claim 1, wherein the filter includes at least one oxidizing agent having an electrode potential of greater than or equal to 0.96 V.

5. The combination as claimed in claim 1, wherein the poly(arylene thioether) is in powder form and has a mean particle size of up to 300 μm.

6. The combination as claimed in claim 1, wherein the filter includes cellulose, cellulose acetate or polyolefins.

7. The combination as claimed in claim 1, wherein the filter includes activated charcoal or aluminum oxide.

8. The combination as claimed in claim 5, wherein the poly(arylene thioether) powder has a particle size of 20 to 100 μm.

9. The combination as claimed in claim 6, wherein the filter includes activated charcoal or aluminum oxide.

10. The combination as claimed in claim 1, wherein the tobacco smoking means is a cigarette.

* * * * *